US009267329B2

(12) United States Patent
Bilen

(10) Patent No.: US 9,267,329 B2
(45) Date of Patent: Feb. 23, 2016

(54) DRILL BIT WITH EXTENSION ELEMENTS IN HYDRAULIC COMMUNICATIONS TO ADJUST LOADS THEREON

(71) Applicant: Juan Miguel Bilen, The Woodlands, TX (US)

(72) Inventor: Juan Miguel Bilen, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 374 days.

(21) Appl. No.: 13/796,494

(22) Filed: Mar. 12, 2013

(65) Prior Publication Data

US 2014/0262511 A1 Sep. 18, 2014

(51) Int. Cl.

| | |
|---|---|
| ***E21B 7/06*** | (2006.01) |
| ***E21B 10/62*** | (2006.01) |
| ***E21B 10/43*** | (2006.01) |
| *E21B 10/32* | (2006.01) |

(52) U.S. Cl.

CPC ..... *E21B 7/064* (2013.01); *E21B 10/43* (2013.01); *E21B 10/62* (2013.01); *E21B 10/322* (2013.01)

(58) Field of Classification Search

CPC ..... E21B 7/24; E21B 7/06; E21B 7/064; E21B 10/42; E21B 10/322; E21B 10/43; E21B 10/62

See application file for complete search history.

(56) References Cited

U.S. PATENT DOCUMENTS

| | | | | |
|---|---|---|---|---|
| 3,809,049 | A * | 5/1974 | Fletcher | B28D 1/222 125/23.01 |
| 4,386,669 | A * | 6/1983 | Evans | 175/269 |
| 4,842,083 | A * | 6/1989 | Raney | 175/325.4 |
| 5,388,649 | A * | 2/1995 | Ilomaki | 175/27 |
| 5,553,678 | A | 9/1996 | Barr et al. | |
| 6,142,250 | A | 11/2000 | Griffin et al. | |
| 7,062,959 | B2 | 6/2006 | Kurkjian et al. | |
| 7,836,975 | B2 * | 11/2010 | Chen | E21B 10/322 175/266 |
| 8,056,651 | B2 * | 11/2011 | Turner | E21B 10/08 175/381 |
| 8,307,914 | B2 * | 11/2012 | Pafitis et al. | 175/61 |
| 8,763,726 | B2 * | 7/2014 | Johnson | E21B 7/06 175/24 |
| 8,881,845 | B2 * | 11/2014 | Dewey et al. | 175/61 |
| 2002/0011358 | A1 * | 1/2002 | Wassell | 175/73 |
| 2007/0221416 | A1 | 9/2007 | Hall et al. | |
| 2010/0071956 | A1 | 3/2010 | Beuershausen | |
| 2010/0071962 | A1 | 3/2010 | Beuershausen | |
| 2012/0318580 | A1 | 12/2012 | Oesterberg | |

OTHER PUBLICATIONS

PCT International Search Report and Written Opinion; International Application No: PCT/US2014/024469; International Filing Date: Mar. 12, 2014; Date of Mailing: Jun. 26, 2014; pp. 1-16.

* cited by examiner

*Primary Examiner* — Kenneth L Thompson

(74) *Attorney, Agent, or Firm* — Cantor Colburn LLP

(57) ABSTRACT

In one aspect, a drill bit is disclosed that in one embodiment includes a plurality of elements that extend and retract from a surface of the drill bit, wherein the plurality of such elements are in fluid communication with each other to compensate for differing forces applied to such elements during drilling operations. In another aspect, a method of drilling a wellbore is provided that in one embodiment includes: conveying a drill string having a drill bit at an end thereof, wherein the drill bit includes a plurality of elements that extend and retract from a surface of the drill bit, wherein the plurality of such elements are in fluid communication with each other to compensate for differing forces applied to such elements during drilling operations; and drilling the wellbore using the drill string.

17 Claims, 4 Drawing Sheets

DRILL BIT WITH EXTENSION ELEMENTS IN HYDRAULIC COMMUNICATIONS TO ADJUST LOADS THEREON

BACKGROUND INFORMATION

1. Field of the Disclosure

This disclosure relates generally to drill bits and systems that utilize same for drilling wellbores.

2. Background of the Art

Oil wells (also referred to as "wellbores" or "boreholes") are drilled with a drill string that includes a tubular member having a drilling assembly (also referred to as the "bottomhole assembly" or "BHA"). The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. When drilling progresses from a soft formation, such as sand, to a hard formation, such as shale, or vice versa, the rate of penetration (ROP) of the drill changes and can cause (decreases or increases) excessive fluctuations or vibration (lateral or torsional) in the drill bit. The ROP is typically controlled by controlling the weight-on-bit (WOB) and rotational speed (revolutions per minute or "RPM") of the drill bit so as to control drill bit fluctuations. The WOB is controlled by controlling the hook load at the surface and the RPM is controlled by controlling the drill string rotation at the surface and/or by controlling the drilling motor speed in the BHA. Controlling the drill bit fluctuations and ROP by such methods requires the drilling system or operator to take actions at the surface. The impact of such surface actions on the drill bit fluctuations is not substantially immediate. Drill bit aggressiveness contributes to the vibration, oscillation and the drill bit for a given WOB and drill bit rotational speed. Depth of cut of the drill bit is a contributing factor relating to the drill bit aggressiveness. Controlling the depth of cut can provide smoother borehole, avoid premature damage to the cutters and longer operating life of the drill bit.

The disclosure herein provides a drill bit and drilling systems using the same configured to control the aggressiveness of a drill bit during drilling of a wellbore.

SUMMARY

In one aspect, a drill bit is disclosed that in one embodiment includes a plurality of elements that extend and retract from a surface of the drill bit, wherein at least two elements in the plurality of elements are in fluid communication with each other to compensate for differing forces applied to such elements during drilling operations.

In another aspect, a method of drilling a wellbore is provided that in one embodiment includes: conveying a drill string having a drill bit at an end thereof, wherein the drill bit includes a plurality of elements that extend and retract from a surface of the drill bit, wherein the plurality of such elements are in fluid communication with each other to compensate for differing forces applied to such elements during drilling operations; and drilling the wellbore using the drill string.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
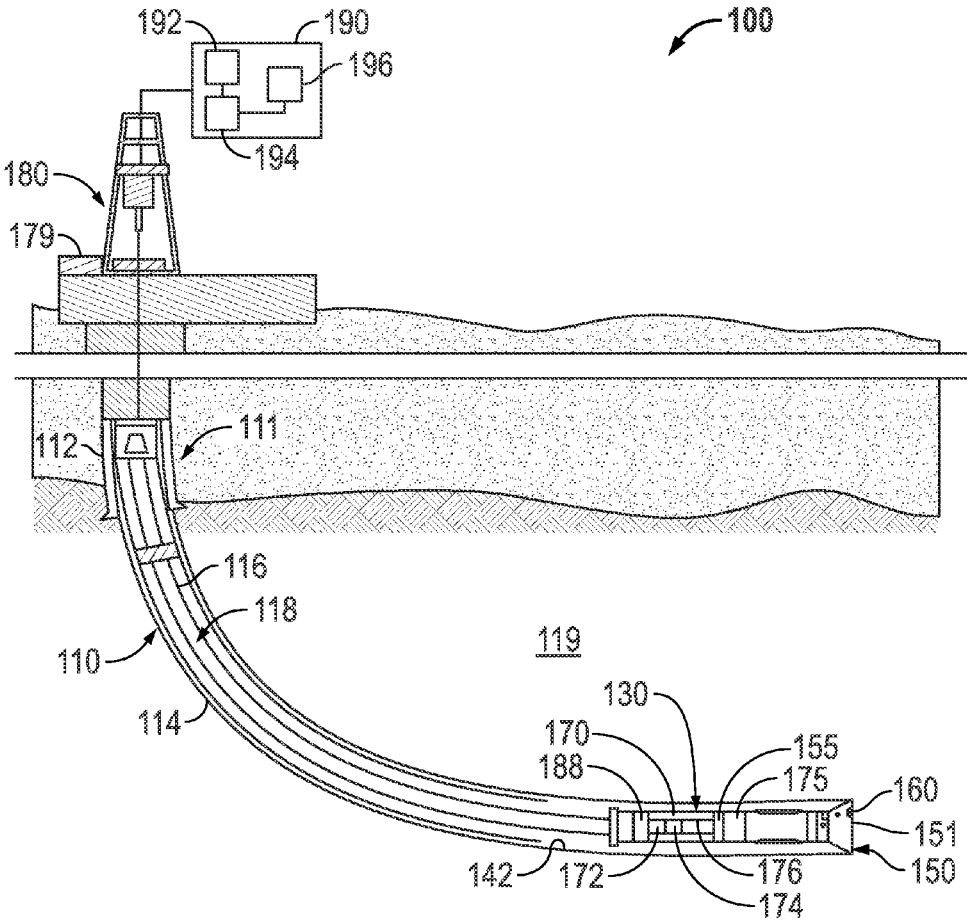
FIG. 1 is a schematic diagram of an exemplary drilling system that includes a drill string that has a drill bit made according to one embodiment of the disclosure.

FIG. 1 is a schematic diagram of an exemplary drilling system 100 that includes a drill string 120 having a drilling assembly or a bottomhole assembly 190 attached to its bottom end. Drill string 120 is shown conveyed in a borehole 126 formed in a formation 195. The drilling system 100 includes a conventional derrick 111 erected on a platform or floor 112 that supports a rotary table 114 that is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to the drilling assembly 190, disintegrates the geological formation 195. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive 114*a* rather than the prime mover and the rotary table 114.

To drill the wellbore 126, a suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* discharges at the borehole bottom 151 through openings in the drill bit 150. The returning drilling fluid 131*b* circulates uphole through the annular space or annulus 127 between the drill string 120 and the borehole 126 and returns to the mud pit 132 via a return line 135 and a screen 185 that removes the drill cuttings from the returning drilling fluid 131*b*. A sensor $S_1$ in line 138 provides information about the fluid flow rate of the fluid 131. Surface torque sensor $S_2$ and a sensor $S_3$ associated with the drill string 120 provide information about the torque and the rotational speed of the drill string 120. Rate of penetration of the drill string 120 may be determined from sensor $S_5$, while the sensor $S_6$ may provide the hook load of the drill string 120.

In some applications, the drill bit 150 is rotated by rotating the drill pipe 122. However, in other applications, a downhole motor 155 (mud motor) disposed in the drilling assembly 190 rotates the drill bit 150 alone or in addition to the drill string rotation. A surface control unit or controller 140 receives: signals from the downhole sensors and devices via a sensor 143 placed in the fluid line 138; and signals from sensors $S_1$-$S_6$ and other sensors used in the system 100 and processes such signals according to programmed instructions provided to the surface control unit 140. The surface control unit 140 displays desired drilling parameters and other information on a display/monitor 141 for the operator. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole devices and may control one or more operations drilling operations.

The drilling assembly 190 may also contain formation evaluation sensors or devices (also referred to as measurement-while-drilling (MWD) or logging-while-drilling (LWD) sensors) for providing various properties of interest, such as resistivity, density, porosity, permeability, acoustic properties, nuclear-magnetic resonance properties, corrosive properties of the fluids or the formation, salt or saline content, and other selected properties of the formation 195 surrounding the drilling assembly 190. Such sensors are generally known in the art and for convenience are collectively denoted herein by numeral 165. The drilling assembly 190 may further include a variety of other sensors and communication devices 159 for controlling and/or determining one or more functions and properties of the drilling assembly 190 (including, but not limited to, velocity, vibration, bending moment, acceleration, oscillation, whirl, and stick-slip) and drilling operating parameters, including, but not limited to, weight-on-bit, fluid flow rate, and rotational speed of the drilling assembly.

Still referring to FIG. 1, the drill string 120 further includes a power generation device 178 configured to provide electrical power or energy, such as current, to sensors 165, devices 159 and other devices. Power generation device 178 may be located in the drilling assembly 190 or drill string 120. The drilling assembly 190 further includes a steering device 160 that includes steering members (also referred to a force application members) 160*a*, 160*b*, 160*c* that may be configured to independently apply force on the borehole 126 to steer the drill bit along any particular direction. A control unit 170 processes data from downhole sensors and controls operation of various downhole devices. The control unit includes a processor 172, such as microprocessor, a data storage device 174, such as a solid-state memory and programs 176 stored in the data storage device 174 and accessible to the processor 172. A suitable telemetry unit 179 provides two-way signal and data communication between the control units 140 and 170.

During drilling of the wellbore 126, it is desirable to control aggressiveness of the drill bit to drill smoother boreholes, avoid damage to the drill bit and improve drilling efficiency. To reduce axial aggressiveness of the drill bit 150, the drill bit is provided with one or more pads 180 configured to extend and retract from the drill bit face 152. A force application unit 185 in the drill bit adjusts the extension of the one or more pads 180, which pads controls the depth of cut of the cutters on the drill bit face, thereby controlling the axial aggressiveness of the drill bit 150.

Figure 2:
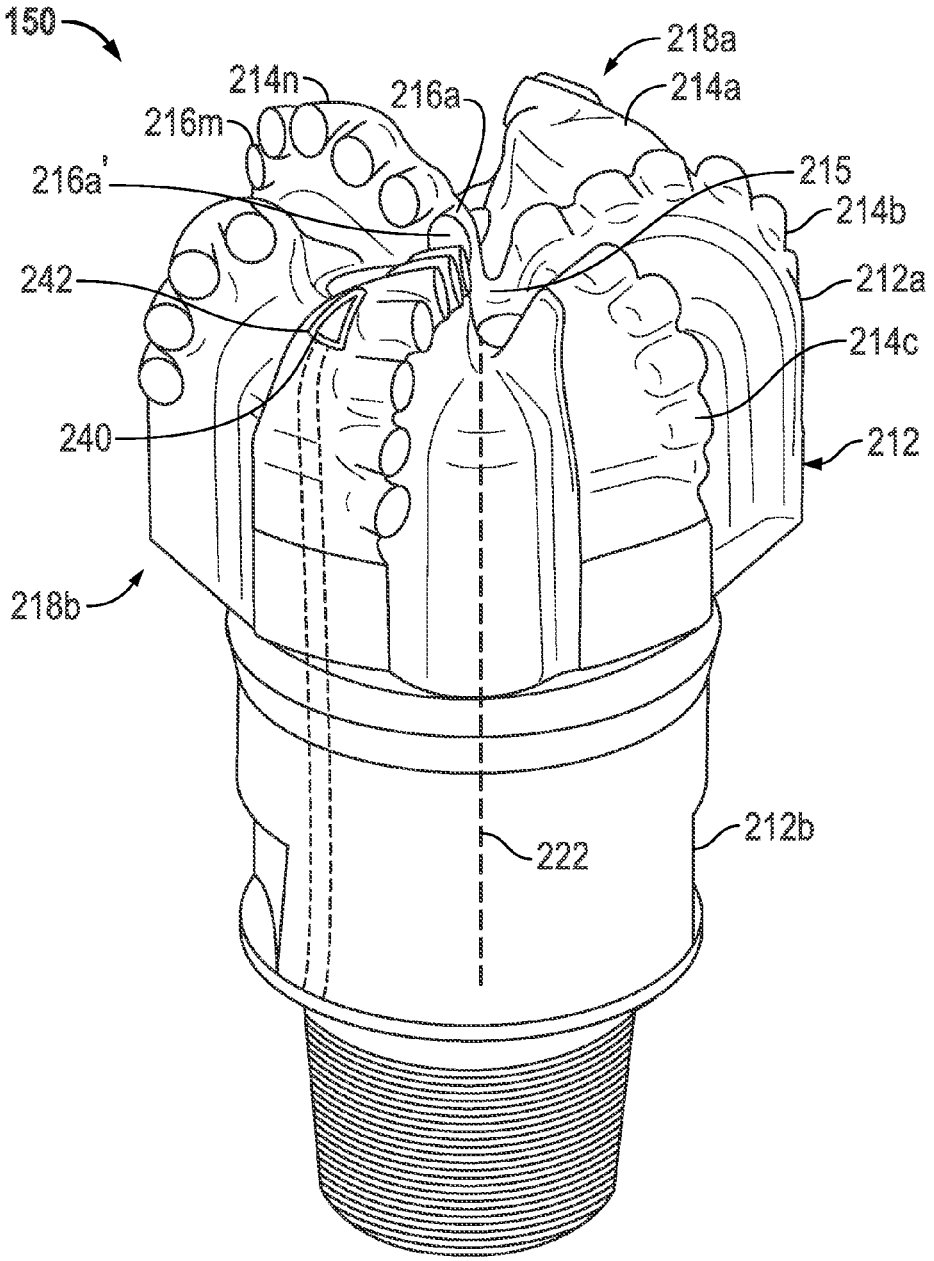
FIG. 2 shows a cross-section of an exemplary drill bit with a force application unit therein for extending and retracting pads on a surface of the drill bit, according to one embodiment of the disclosure.

FIG. 2 shows an exemplary drill bit 200 made according to one embodiment of the disclosure. The drill bit 200 is a polycrystalline diamond compact (PDC) bit having a bit body 210 that includes a shank 212 and a crown 230. The shank 212 includes a neck or neck section 214 that has a tapered threaded upper end 216 having threads 216*a* thereon for connecting the drill bit 150 to a box end at the end of the drilling assembly 130 (FIG. 1). The shank 212 has a lower vertical or straight section 218. The shank 210 is fixedly connected to the crown 230 at joint 219. The crown 230 includes a face or face section 232 that faces the formation during drilling. The crown includes a number of blades, such as blades 234*a* and 234*b*, each n. Each blade has a number of cutters, such as cutters 236 on blade 234*a* at blade having a face section and a side section. For example, blade 234*a* has a face section 232*a* and a side section 236*a* while blade 234*b* has a face section 232*b* and side section 236*b*. Each blade further includes a number of cutters. In the particular embodiment of FIG. 2, blade 234*a* is shown to include cutters 238*a* on the face section 232*a* and cutters 238*b* on the side section 236*a* while blade 234*b* is shown to include cutters 239*a* on face 232*b* and cutters 239*b* on side 236*b*. The drill bit 150 further includes one or more pads, such as pads 240*a* and 240*b*, each configured to extend and retract relative to the drill bit surface 232. In another aspect, one or more cutters may be configured to extend and retract form a surface of the drill bit. For the purpose of this disclosure, an extendable-retractable pad or cutter is also referred to herein as an extendable or retractable "element." A drill bit made according an embodiment according to this disclosure may include at least two elements (at least one pads, at least two cutters or at least one pad and at least one cutter) hydraulically coupled to each other in a manner that when one of such element extends retracts, it moves the hydraulic fluid toward one or more of the other elements hydraulically coupled to such an element as described in more detail in reference to FIGS. 3-5.

Figure 3:
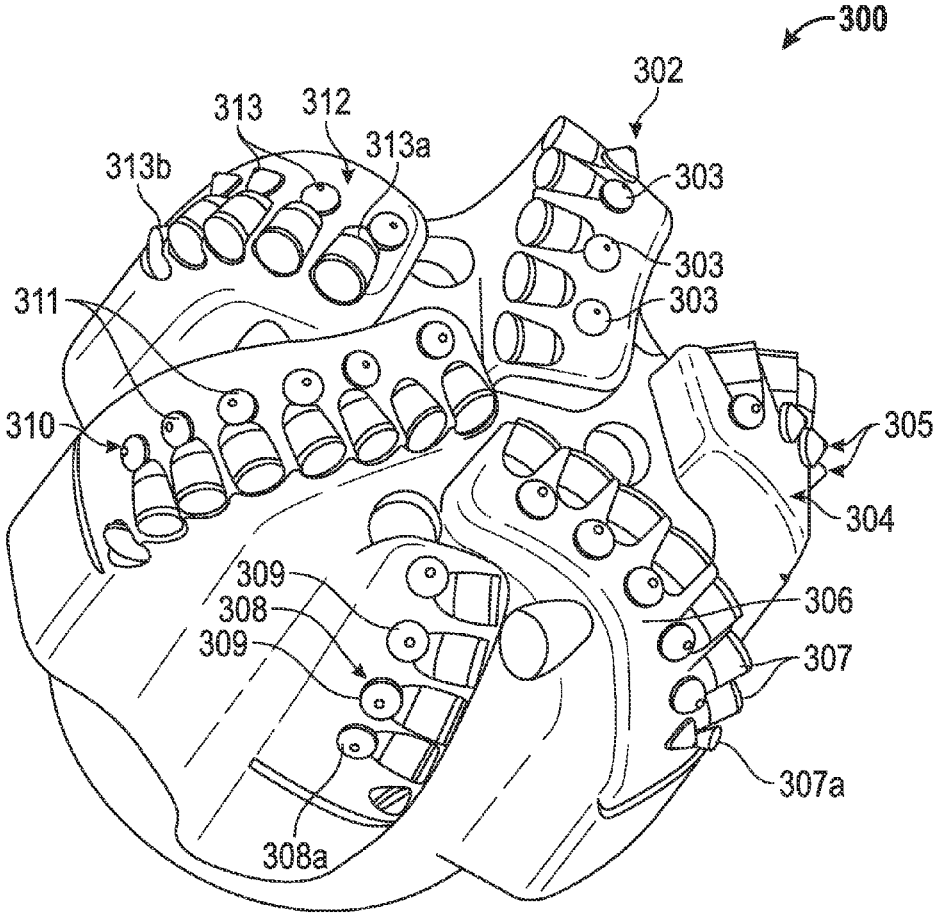
FIG. 3 is a sectional vie showing a number of extendable and retractable pads on different surfaces of an exemplary drill bit made according to one embodiment of the disclosure.

FIG. 3 shows a crown portion of an exemplary PDC drill bit 300 that includes a number of extendable and retractable pads on the various blades of the drill bit 300. For example, blade 302 includes pads 303, blade 304 includes pads 305, blade 306 includes pads 307, blade 308 includes pads 309, blade 310 includes pads 311 and blade 312 includes pads 313. On each such blade some of the pads may be on the face of the blade and some on the side of the blade. As an example, pad 313*a* is shown to be on the face of blade 312 and pad 313*b* is shown to be on the side of the blade 312. In other configurations, the pads may be on the face of the blades or on the side of the blades. Furthermore, only selected blades may include one or more extendable and retractable pads. In other configurations, one or more cutters may be extendable and retractable.

Figure 4:
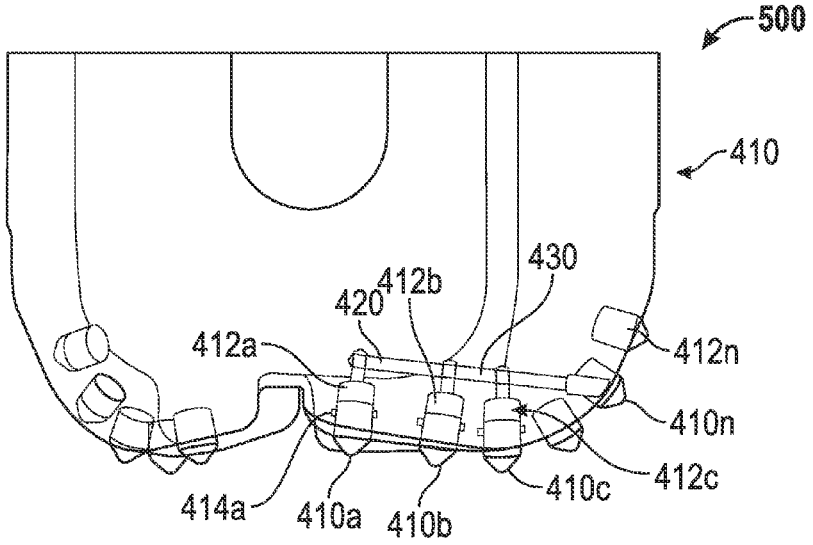
FIG. 4 is a sectional side view of the drill bit of FIG. 3 showing certain exemplary hydraulically-compensated pads, according to an embodiment of this disclosure.

FIG. 4 is a sectional side view 400 of the drill bit 300 of FIG. 3 showing certain exemplary hydraulically-compensated pads, according to an embodiment of this disclosure. FIG. 4 shows only certain pads for clarity of explanation. In FIG. 4, pads 410*a*, 410*b*, 410*c* and 410*n* are in hydraulic communication with each other. In this configuration, each such pad is configured to extend and retract from a surface of the drill bit. In one aspect, each pad moves within a sealed chamber. For example, pad 410*a* moves within a chamber 412*a* that has a fluid 420 at the back of the chamber 412*a*. A seal 414*a* around pad 410*a* seals the fluid within the chamber

412*a* while allowing the pad 410*a* to move in and out of the chamber. Similarly pad 410*b* moves in chamber 412*b*, pad 410*c* moves in chamber 412*c* and pad 410*n* moves in chamber 412*n*. A conduit 430 filled with the fluid 420 connects chambers 412*a*, 412*b*, 412*c* and 412*n* to cause the pads 310*a*, 410*b*, 410*c* and 410*n* in hydraulic communication with each other. The fluid 420 is substantially incompressible and the amount of the fluid is selected based on the amount of pads can travel within the chambers. In such a configuration, when the drill is idle (not in contact with the wellbore bottom), the back pressure or the load on each pad is substantially zero and thus each pad will extend substantially the same distance from its respective surface. When the drill bit is operational, i.e., the drill bit is pressed against the bottom of the wellbore, the load on different pads may be different. If for example, the load on pad 410*a* and 410*b* is the same but is less than the load on pad 410*c* and pad 410*n* as well as pads 410*a* and 410*b*, then the pads 410*a* and 410*b* will retract, pushing the fluid in their respective chambers toward chambers 412*c* and 410*n*, causing the pads 410*c* and 410*n* to extend. The relative extension of the pads 412*c* and 412*n* will depend on the loads on pads 410*c* and 410*n*. Thus, when one pad retracts from a drill bit surface, one or more pads may extend depending upon the relative loads on all hydraulically coupled pads. In other configurations, one or more pads may be hydraulically coupled to one or more cutters on the same blade or different blades (The pads and/or the cutters may be on the same or different planes.

Figure 5:
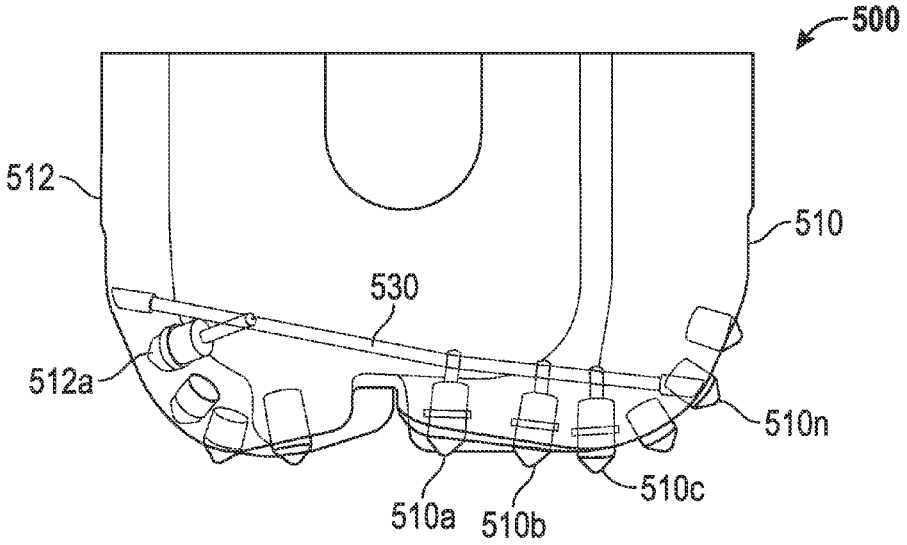
FIG. 5 is a sectional side view of the drill bit of FIG. 3 showing certain exemplary hydraulically-compensated pads and cutters according to another embodiment of this disclosure.

FIG. 5 is a sectional side view of the drill bit 500 of FIG. 3 showing certain exemplary hydraulically-compensated elements (pads) according to another embodiment of this disclosure. In the drill bit 500, certain pads and certain pads in a second blade are hydraulically compensated. As shown, pads 510*a*, 510*b*, 510*c* and 510*n* associated with blade 520 and pad 512*a* associated with blade 512 are hydraulically coupled and compensated via a common fluid line 530. The operation of these pads is the same as described in reference to hydraulically-compensated pads in reference to FIG. 4.

The concepts and embodiments described herein are useful to control the axial aggressiveness of drill bits on demand and in real time during drilling. Such drill bits aid in: (a) steering the drill bit along a desired direction; (b) dampening the level of vibrations and (c) reducing the severity of stick-slip while drilling, among other aspects. Moving the pads up and down changes the drilling characteristic of the bit. Varying the depth of the pads based on the load asserted on such pads more uniformly distributes the loads on such pads and the cutters, thereby aiding in forming of more uniform boreholes and increasing the life of the cutters and the pads.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A drill bit, comprising:

a plurality of elements that extend and retract from a surface of the drill bit, wherein the elements in the plurality of elements are in fluid communication with each other to compensate for differing forces applied to such elements during a drilling operation, wherein retraction of a first element in the plurality of elements causes a second element in the plurality of elements to extend.

2. The drill bit of claim 1, wherein the plurality of elements includes one of: a pad; cutter; and at least one cutter and at least one pad.

3. The drill bit of claim 1, wherein the plurality of elements is placed on one of: a single blade; at least two blades; and a blade and a side of the drill bit.

4. The drill bit of claim 1, wherein each of the elements in the plurality of elements includes a fluid chamber within which the element reciprocates in order to extend and retract from the surface of the drill bit.

5. The drill bit of claim 4 further comprising a hydraulic passage configured to enable the fluid communication among the elements in the plurality of elements.

6. The drill bit of claim 1, wherein each of the elements is substantially equally extended from the surface when the drill bit is idle.

7. A method of making a drill bit, comprising:

providing a drill bit having a plurality elements, wherein each such element is configured to extend and retract from a surface of the drill bit; and providing fluid communication among each of the plurality of elements to compensate for differing forces applied to such elements during a drilling operation, wherein the fluid communication enables a first element in the plurality of elements to extend when a second element in the plurality of elements retracts due to a load applied on the second element.

8. The method of claim 7, wherein the plurality of elements includes one of: a pad; a cutter; and at least one pad and at least one cutter.

9. The method of claim 7, wherein the plurality of elements is placed on one of: a single blade; at least two blades; and a blade and a side of the drill bit.

10. The method of claim 7, wherein each element in the plurality of elements is configured to reciprocate in a chamber in order to extend and retract from the surface of the drill bit.

11. The method of claim 7 further comprising a hydraulic passage configured to enable the fluid communication among the elements in the plurality of elements.

12. A method of drilling a wellbore, comprising:

conveying a drill string having a drill bit at an end thereof, wherein the drill bit includes a plurality of elements that extend and retract from a surface of the drill bit, wherein the plurality of such elements are in fluid communication with each other to compensate for differing forces applied to such elements during drilling operations so that retraction of an element causes another element to extend; and drilling the wellbore using the drill string.

13. The method of claim 12, wherein the plurality of elements is located on one of: a single blade; at least two blades; and a blade and a side of the drill bit.

14. The method of claim 12, wherein each of the elements in the plurality of elements reciprocates in a fluid chamber that has a fluid associated therewith.

15. The method of claim 14 further comprising providing a hydraulic passage configured to enable the fluid communication among the plurality of elements.

16. A drilling system, comprising:

a drilling assembly having a drill bit at an end thereof configured to drill a wellbore, wherein the drill bit includes a plurality of elements that extend and retract from a surface of the drill bit, wherein the elements in the plurality of elements are in fluid communication to compensate for differing forces applied to elements during drilling operations so that retraction of a first element in the plurality of elements causes a second element in the plurality of elements to extend.

17. The drilling system of claim 16, wherein the drilling assembly includes a sensor configured to provide information relating a downhole parameter during a drilling operation.

* * * * *